US011542613B2

(12) United States Patent
Biener et al.

(10) Patent No.: US 11,542,613 B2
(45) Date of Patent: Jan. 3, 2023

(54) FLOW-THROUGH REACTOR FOR ELECTROCATALYTIC REACTIONS

(71) Applicant: LAWRENCE LIVERMORE NATIONAL SECURITY, LLC, Livermore, CA (US)

(72) Inventors: Monika M. Biener, San Leandro, CA (US); Juergen Biener, San Leandro, CA (US); Siwei Liang, Dublin, CA (US); Zhen Qi, Tracy, CA (US); Michael Stadermann, Pleasanton, CA (US); Vedasri Vedharathinam, Fremont, CA (US)

(73) Assignee: Lawrence Livermore National Security, LLC, Livermore, CA (US)

( * ) Notice: Subject to any disclaimer, the term of this patent is extended or adjusted under 35 U.S.C. 154(b) by 0 days.

(21) Appl. No.: 17/354,664

(22) Filed: Jun. 22, 2021

(65) Prior Publication Data

US 2021/0317587 A1 Oct. 14, 2021

Related U.S. Application Data

(62) Division of application No. 15/946,424, filed on Apr. 5, 2018, now Pat. No. 11,053,597.

(51) Int. Cl.

| | |
|---|---|
| ***C25B 11/057*** | (2021.01) |
| ***C25B 15/08*** | (2006.01) |
| ***C25B 3/25*** | (2021.01) |
| ***C25B 9/19*** | (2021.01) |
| ***C25B 11/031*** | (2021.01) |
| ***C25B 11/061*** | (2021.01) |
| ***C25B 3/26*** | (2021.01) |

(52) U.S. Cl.
CPC ..... *C25B 11/057* (2021.01); *C25B 3/25* (2021.01); *C25B 3/26* (2021.01); *C25B 9/19* (2021.01); *C25B 11/031* (2021.01); *C25B 11/061* (2021.01); *C25B 15/08* (2013.01)

(58) Field of Classification Search
None
See application file for complete search history.

(56) References Cited

U.S. PATENT DOCUMENTS

| | | | |
|---|---|---|---|
| 3,853,738 | A | 12/1974 | Loftfield et al. |
| 3,972,795 | A | 8/1976 | Goens et al. |
| 4,129,493 | A | 12/1978 | Tighe et al. |
| 4,297,194 | A | 10/1981 | Dotson et al. |
| 10,329,676 | B2 | 6/2019 | Kaczur et al. |
| 2007/0224099 | A1 | 9/2007 | Biener et al. |
| 2008/0223727 | A1 | 9/2008 | Oloman et al. |

(Continued)

FOREIGN PATENT DOCUMENTS

| | | | |
|---|---|---|---|
| WO | WO-2016/039999 | A1 | 3/2016 |
| WO | WO-2016/054400 | A1 | 4/2016 |

OTHER PUBLICATIONS

Aeshala et al., "Effect of solid polymer electrolyte on electrochemical reduction of CO2", Separation and Purification Technology, vol. 94, Jan. 2012, pp. 137-137.

(Continued)

*Primary Examiner* — Harry D Wilkins, III
(74) *Attorney, Agent, or Firm* — Foley & Lardner LLP

(57) ABSTRACT

A flow-through electrolysis cell includes a hierarchical nanoporous metal cathode. A method of reducing $CO_2$ includes flowing the $CO_2$ through the hierarchical nanoporous metal cathode of the flow-through electrolysis cell.

15 Claims, 6 Drawing Sheets

(56) References Cited

U.S. PATENT DOCUMENTS

| | | | |
|---|---|---|---|
| 2013/0105304 | A1 | 5/2013 | Kaczur et al. |
| 2013/0186771 | A1 | 7/2013 | Zhai et al. |
| 2016/0076155 | A1 | 3/2016 | Kim et al. |
| 2018/0057950 | A1 | 3/2018 | Co et al. |
| 2019/0144310 | A1 | 5/2019 | Campbell et al. |
| 2019/0368059 | A1 | 12/2019 | Veening et al. |

OTHER PUBLICATIONS

Bagge-Hansen, M. et al. (2014) "Quantitative Phase Composition of TiO2-Coated Nanoporous Au Monoliths by X-ray Absorption Spectroscopy and Correlations to Catalytic Behavior," J. Phys. Chem. C 118(8):4078-4084.

Biener, J. et al. (2006) "Size Effects on the Mechanical Behavior of Nanoporous Au," Nano Lett. 6(10):2379-2382.

Biener, J. et al. (2008) "Nanoporous Plasmonic Metamaterials," Adv. Mater. 20:1211-1217.

Biener, J. et al. (2008) "Surface-chemistry-driven actuation in nanoporous gold," Nature Materials 8:47-51.

Biener, J. et al. (2011) "Advanced carbon aerogels for energy applications," Energy & Environmental Science 4:656-667.

Biener, J. et al. (2015) "Nanoporous Gold: Understanding the Origin of the Reactivity of a 21st Century Catalyst Made by Pre-Columbian Technology," ACS Catal. 5(11):6263-6270.

Biener, M.M. et al. (2011) "ALD Functionalized Nanoporous Gold: Thermal Stability, Mechanical Properties, and Catalytic Activity," Nano Lett. 11(8):3085-3090.

Biener, M.M. et al. (2014) "Ultra-strong and low-density nanotubular bulk materials with tunable feature sizes," Adv Mater. 26(28):4808-4813.

Billy et al., Experimental Parameters Influencing Hydrocarbon Selectivity during the Electrochemical Conversion of CO2, ACD Catalysis, vol. 7, No. 12, Nov. 2017, pp. 8467-8479.

Campbell, P. et al. (2014) "Battery/supercapacitor hybrid via non-covalent functionalization of graphene macro-assemblies," J. Mater. Chem. A, 2:17764-17770.

Final Office Action on U.S. Appl. No. 15/946,424 dated Nov. 17, 2020.

Hayes, J.R. et al. (2006) "Monolithic nanoporous copper by dealloying Mn—Cu," J. Mater. Res. 21(10):2611-2616.

Jhong, H-R.M. et al. (2013) "Electrochemical conversion of CO2 to useful chemicals: Current status, remaining challenges, and future opportunities," Current Opinion in Chemical Engineering 2(2):191-199.

Kas, R. et al. (2016) "Three-dimensional porous hollow fibre copper electrodes for efficient and high-rate electrochemical carbon dioxide reduction," Nat. Commun. 7:10748.

Kong et al., "Fabrication and compression properties of bulk hierarchical nanoporous copper with fine ligament", Materials Letters, vol. 127, Mar. 2014, pp. 59-62.

Li et al., "Hierarchical nested-network porous copper fabricated by one-step dealloying for glucose sensing", Journal of Alloys and Compounds, vol. 681, Apr. 2016, pp. 109-114.

Merino-Garcia et al, "Electrochemical membrane reactors for the utilisation of carbon dioxide", Chemical Engineering Journal, vol. 305, May 2016, pp. 104-120.

Non-Final Office Action on U.S. Appl. No. 15/946,424 dated Jul. 2, 2020.

Notice of Allowance on U.S. Appl. No. 15/946,424 dated Mar. 29, 2021.

Roberts, F.S. et al. (2015) "High selectivity for ethylene from carbon dioxide reduction over copper nanocube electrocatalysts," Angew Chem Int Ed Engl. 54(17):5179-5182.

Suss et al., "Capacitive desalination with flow-through electrodes," Energy and Environmental Science, vol. 5, Jun. 26, 2012, pp. 9511-9519.

Tang, W. et al. (2012) "The importance of surface morphology in controlling the selectivity of polycrystalline copper for CO2 electroreduction," Phys. Chem. Chem. Phys. 14:76-81.

Vega, A.A. et al. (2014) "Nanoporous Metals Fabricated through Electrochemical Dealloying of Ag-Au-Pt with Systematic Variation of Au:Pt Ratio," J. Electrochem. Soc. 161(1):C1-C10.

Wang et al., "Nanostructured nonprecious metal catalysts for electrochemical reduction of carbon dioxide", Nano Today. vol. 11, Jun. 2016, pp. 373-391.

Wang, C. et al. (2011) "Defining the Nanostructured Morphology of Triblock Copolymers Using Resonant Soft X-ray Scattering," Nano Lett. 11(9):3906-3911.

Wichmann, A. et al. (2013) "Maximizing Activity and Stability by Turning Gold Catalysis Upside Down: Oxide Particles on Nanoporous Gold," Chemcatchem 5(7):2037-2043.

Wittstock, A. et al. (2010) "Nanoporous gold catalysts for selective gas-phase oxidative coupling of methanol at low temperature," Science 327(5963):319-322.

Wittstock, A. et al. (2012) "Chapter 1: Introduction to Nanoporous Gold," RSC Nanoscience & Nanotechnology 22:1-10.

Xing et al., "Structure Evolution of Nanoporous Copper by dealloying of Al 17-33 at %Cu alloy", International Journal of Electrochemical Science, vol. 10, No. 6, Apr. 2015, pp. 4849-4859.

Zhang, S. et al. (2011) "A three-dimensional tin-coated nanoporous copper for lithium-ion battery anodes," J. Power Sources 196:6915-6919.

FIG. 1: hnp-Cu
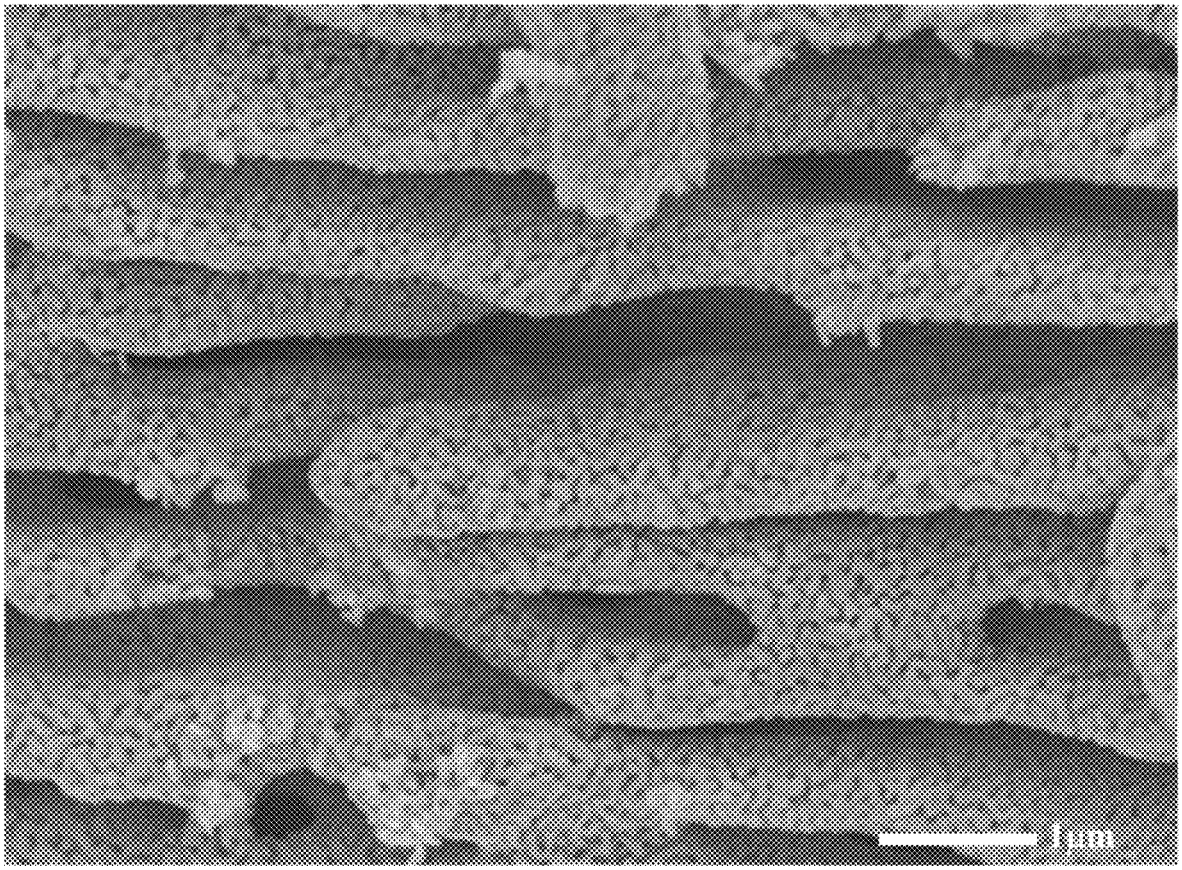

FIG. 2A: Flow-through electrolysis cell with AEM
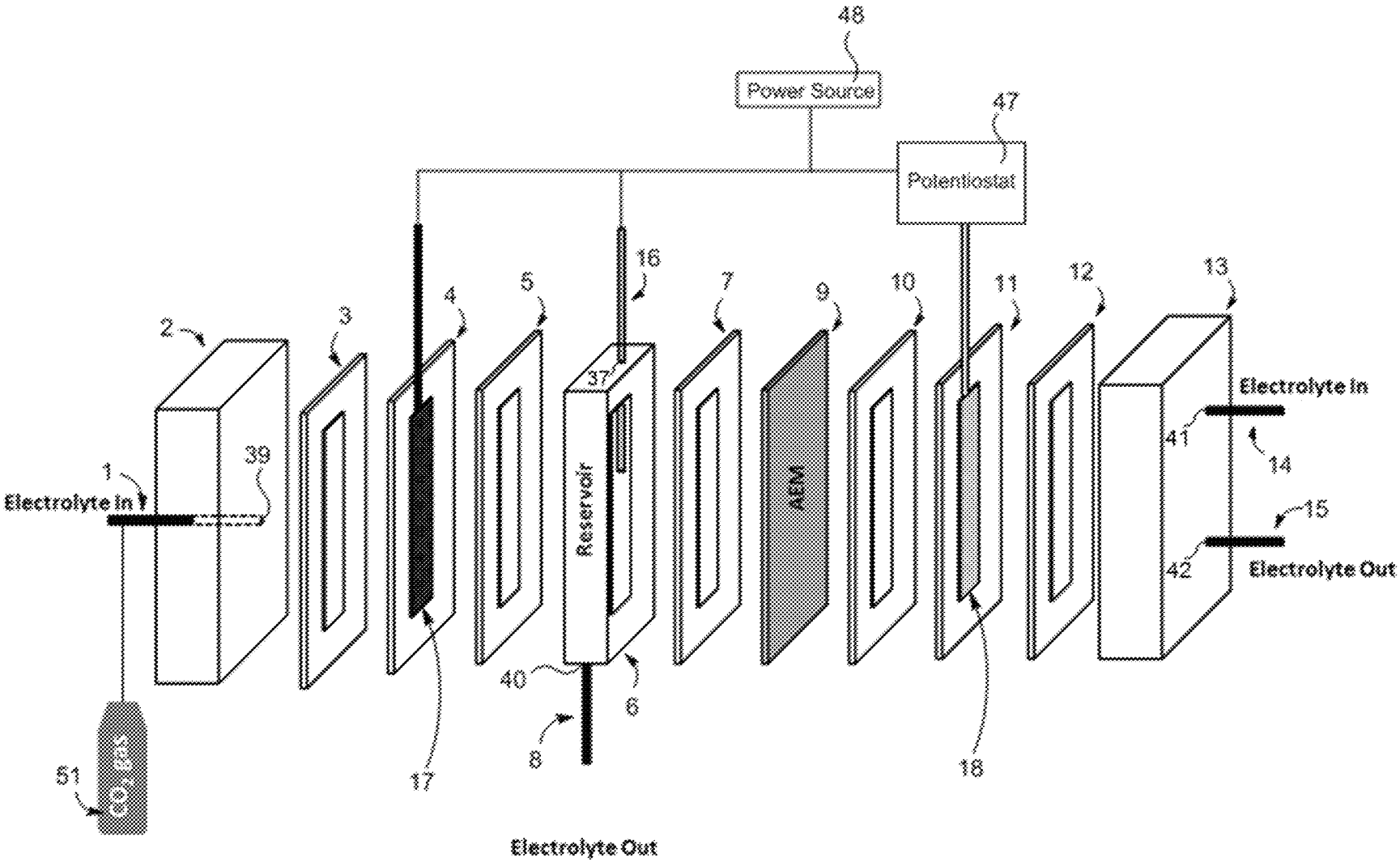

FIG. 2B: Flow-through electrolysis cell with PEM
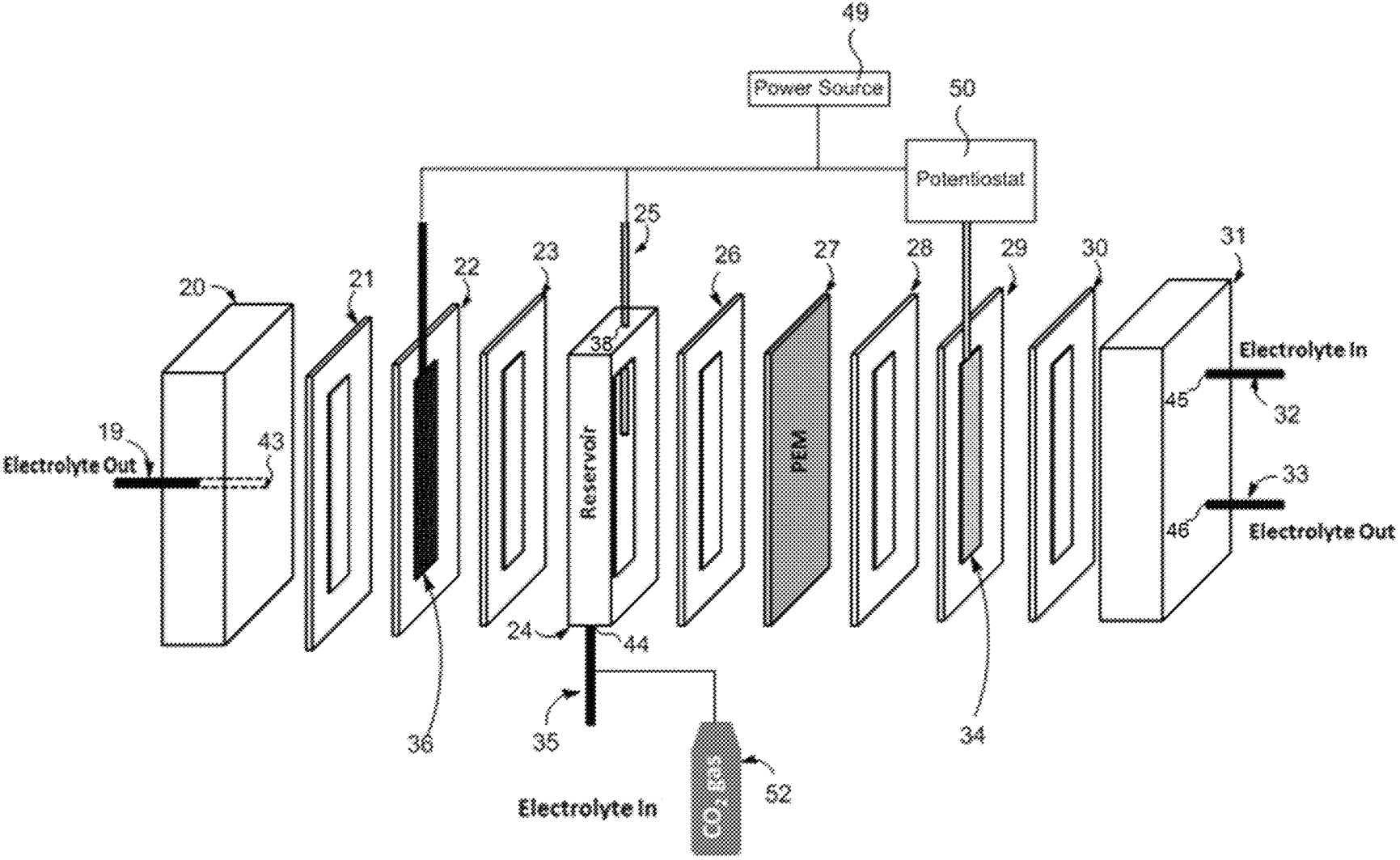

FIG. 3: Flow-by electrolysis cell
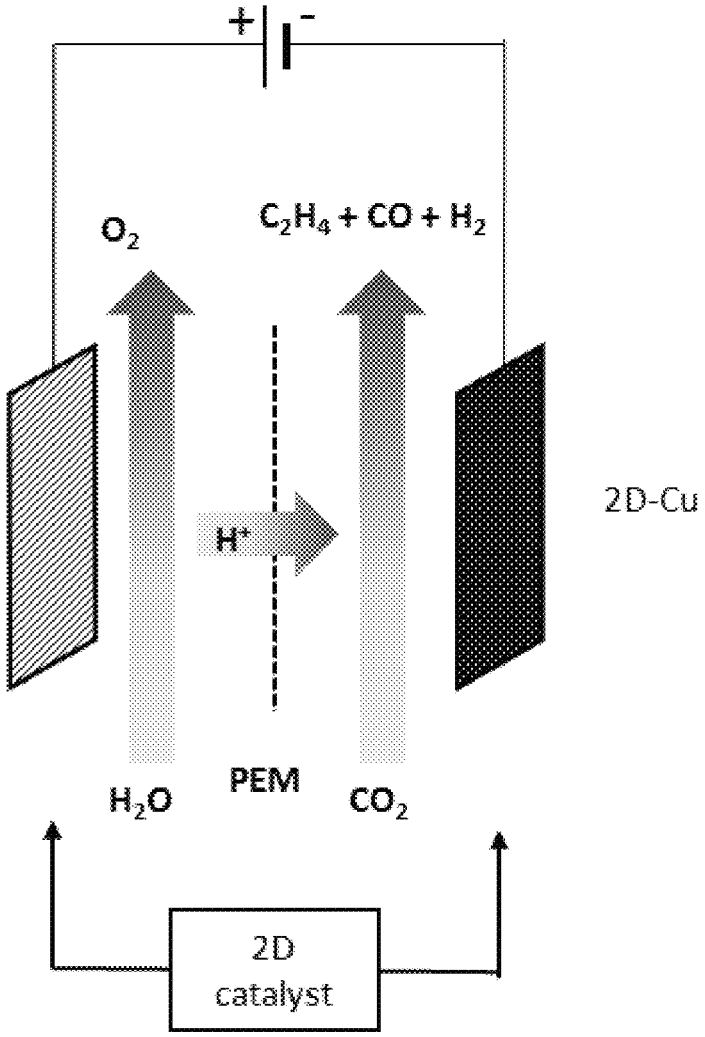

FIG. 4A: Flow-through cell with PEM
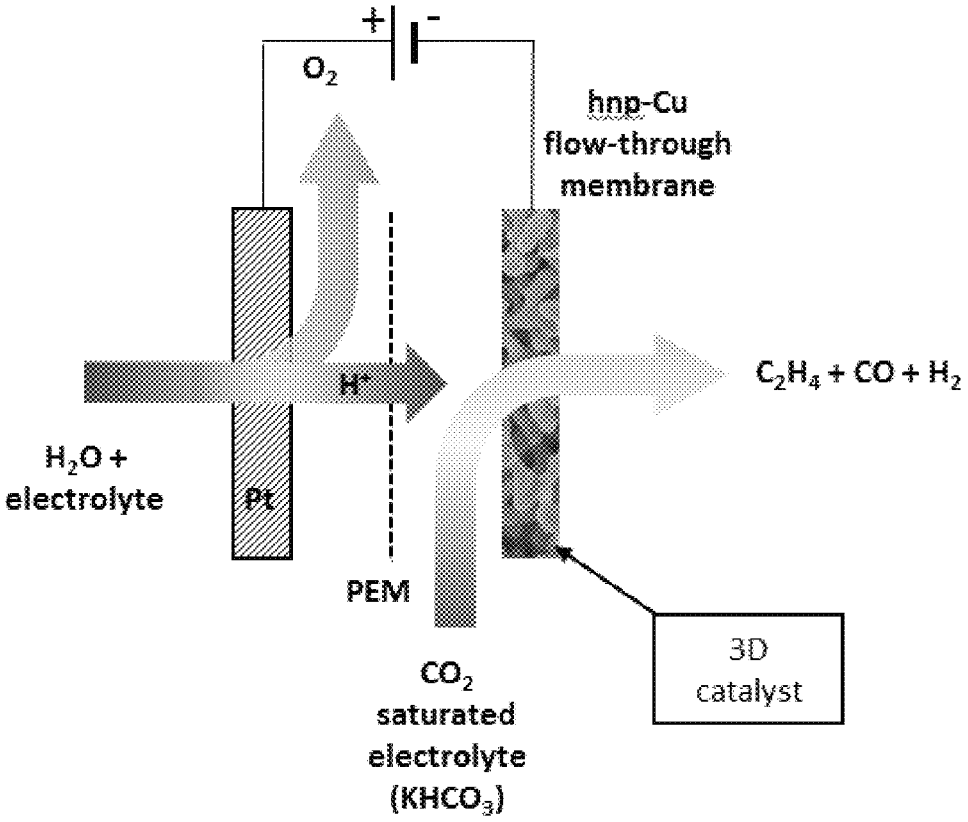

FIG. 4B: Flow-through cell with AEM
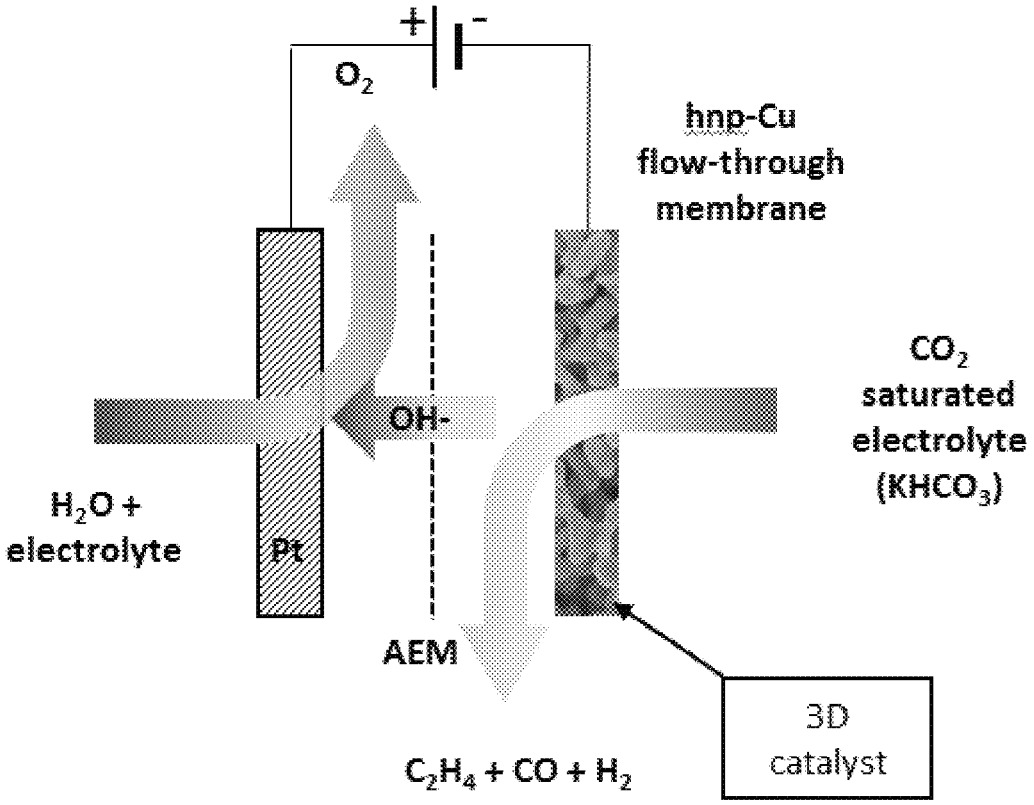

FLOW-THROUGH REACTOR FOR ELECTROCATALYTIC REACTIONS

CROSS REFERENCE TO RELATED APPLICATIONS

This application is a divisional of U.S. application Ser. No. 15/946,424, filed Apr. 5, 2018, the contents of which are incorporated herein by reference in their entirety.

FEDERAL FUNDING STATEMENT

The United States Government has rights in the invention pursuant to Contract No. DE-AC52-07NA27344 between the U.S. Department of Energy and Lawrence Livermore National Security, LLC, for the operation of Lawrence Livermore National Laboratory.

SUMMARY

In one aspect, a flow-through electrolysis cell is provided. The cell includes a cathode including a hierarchical nanoporous metal; an anode including a metallic mesh; and an ion-exchange membrane; wherein the hierarchical nanoporous metal is a catalytic metal for reduction of a reactant which contacts the hierarchical nanoporous metal.

In some embodiments, the hierarchical nanoporous metal may include one or more of copper, platinum, silver, gold, nickel, iron, and zinc. In some embodiments, the hierarchical nanoporous metal may be copper. In some embodiments, the hierarchical nanoporous metal may be a dealloyed metal alloy. In some embodiments where the hierarchical nanoporous metal is hierarchical nanoporous copper, the hierarchical nanoporous copper may be a dealloyed aluminum-copper alloy. In any of the above embodiments, the hierarchical nanoporous metal may have an average nanopore diameter of about 10 nm to about 500 nm and an average macropore diameter of about 500 nm to about $10^6$ nm.

In some embodiments, the metallic mesh may include one or more of platinum, porous platinum, iridium, nickel, iron, palladium, carbon, and boron-doped carbon/diamond. In some embodiments, the metallic mesh may include platinum. In any of the above embodiments, the metallic mesh may include a plurality of pores having an average pore diameter of about 1 μm to about 10,000 μm.

In some embodiments, the flow-through electrolysis cell may further include a reference electrode. In some embodiments, the reference electrode may include one or more of silver, copper, platinum, palladium, mercury, and hydrogen. In some embodiments, the reference electrode may include silver.

In any of the above embodiments, the reactant may be $CO_2$.

In any of the above embodiments, the cathode may contain a first face and an opposite facing second face, the flow-through electrolysis cell may include a first electrolytic fluid input proximal to the first face and a first electrolytic fluid output proximal to the second face, such that the cell is configured to convey an electrolyte through the hierarchical nanoporous metal.

In some embodiments, the electrolyte may include $CO_2$. In some embodiments, the electrolyte may be a $KHCO_3$ solution. In some embodiments, the electrolyte may be a $KH_2PO_4/K_2HPO_4$ buffer. In some embodiments, the $KH_2PO_4$, $K_2HPO_4$, or $KHCO_3$ may be present from 0.1 M to 5 M.

In some embodiments, the ion-exchange membrane may be an anion exchange membrane (AEM). In other embodiments, the ion-exchange membrane may be a proton exchange membrane (PEM).

In another aspect, a method is provided of reducing $CO_2$. The method includes contacting $CO_2$ with a cathode housed in a flow-through electrolysis cell; wherein the cathode comprises a hierarchical nanoporous metal; wherein the flow-through electrolysis cell comprises an anode and an ion-exchange membrane, wherein the anode comprises a metallic mesh; wherein the $CO_2$ is dissolved in an electrolyte; and wherein contacting $CO_2$ with the cathode comprises flowing the electrolyte through the cathode.

In another embodiment, the method includes reducing $CO_2$ to produce a hydrocarbon, an aldehyde, an alcohol, a ketone, a carboxylic acid, or a mixture of any two or more thereof. Where the product is a hydrocarbon, the hydrocarbon produced may include ethylene, methane, or a mixture thereof. In some of the above embodiments, the method may include monitoring the composition of product using an analytical technique. In another embodiment, the analytical technique is gas chromatography mass spectrometry (GCMS).

In any of the above embodiments, the flowing may include applying a pressure gradient across the cathode, in a further embodiment the pressure gradient may be from about 0.1 atm to about 10 atm. In any of the above embodiments, the electrolyte flows through the cathode at a velocity of less than about 1 cm/s.

In any of the above embodiments, the electrolyte may contain $KH_2PO_4$, $K_2HPO_4$, or $KHCO_3$. In any of the above embodiments, the $KH_2PO_4$, $K_2HPO_4$, or $KHCO_3$ may be present in the electrolyte from 0.1 to 5 M. In some embodiments, the electrolyte is saturated with $CO_2$.

In some embodiments, the cathode may include one or more of copper, platinum, silver, gold, nickel, iron, and zinc. In some embodiments, the anode may include one or more of platinum, palladium, carbon and boron-doped/diamond.

BRIEF DESCRIPTION OF THE DRAWINGS

FIG. 1 is a scanning electron micrograph of hierarchical nanoporous copper prepared by dealloying $Al_2Cu$ in NaOH.

FIGS. 2A and 2B are schematic representations of illustrative flow-through electrolysis cells. FIG. 2A illustrates the use of an AEM in the cell, and FIG. 2B illustrates the use of a PEM.

FIG. 3 illustrates a traditional flow-by electrolysis cell for comparison purposes.

FIG. 4A illustrates a flow-through electrolysis cell including an AEM and hierarchical nanoporous copper cathode that offers $10^4$ times higher internal surface area for catalysis vs. the nonporous cathode of the flow-by electrolysis cell of FIG. 3. FIG. 4B illustrates a flow-through electrolysis cell including a PEM and hierarchical nanoporous copper cathode that offers $10^4$ times higher internal surface area for catalysis vs. the nonporous cathode of the flow-by electrolysis cell of FIG. 3. In FIG. 4A and FIG. 4B the entire electrode volume contributes to the reduction of $CO_2$.

DETAILED DESCRIPTION

Among those benefits and improvements that have been disclosed, other objects and advantages of this invention may become apparent from the following description taken in conjunction with the accompanying figures. Detailed embodiments of the present invention are disclosed herein;

however, it is to be understood that the disclosed embodiments are merely illustrative and may be embodied in various forms. In addition, each of the examples given in connection with the various embodiments is intended to be illustrative, and not restrictive. Any alterations and further modifications of the features illustrated herein, and any additional applications of the principles illustrated herein, which can normally occur to one skilled in the relevant art and having possession of this disclosure, are to be considered within the scope of the application.

Throughout the specification and claims, the following terms take the meanings explicitly associated herein, unless the context clearly dictates otherwise. The phrases "in one aspect" and "in some aspects" and the like, as used herein, do not necessarily refer to the same embodiment(s), though they may. Furthermore, the phrases "in another aspect" and "in some other aspects" as used herein do not necessarily refer to a different aspect (embodiment), although they may. Thus, as described below, various aspects (embodiments) of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

As used herein, use of the term "flow-through" to describe an electrolysis cell describes a cell wherein electrolyte flows through an electrode rather than "flowing-by" the electrode. FIG. 3 vs FIGS. 4A and 4B contrast "flow-by" and "flow-through" electrolysis cells, respectively.

As used herein, the term "hierarchical nanoporous" ("hnp") is used to describe a metal that possess a three-dimensional structure of randomly interpenetrating macropores, nanopores and channels, as illustrated by the photograph in FIG. 1. The pores and channels have sizes between 1 nm and 1 mm. Macropores greater than 100 nm in size are needed for mass transport of the electrolyte through the electrode, these macropores reduce flow resistance. Nanopores of less than 100 nm in size are needed for increased surface area and high reduction efficiency.

As used herein, the term "direct ink writing" refers to a technique whereby a material may be extruded from a small nozzle while the nozzle is moved across a platform. The hnp material may be produced using this technique by depositing a material from the nozzle and drawing the hnp shape onto the platform, layer by layer.

As used herein, the term "dealloying" or "dealloying a metal alloy" refers to the selective corrosion of one or more components of the alloy and subsequent removal of the corroded component(s).

As used herein, the term "half-cell" refers to a portion of the flow-through electrolysis cell that is separated by an ion-exchange membrane from the rest of the flow-through electrolysis cell, or the other half-cell. The electrolyte cannot flow from one half-cell into the other half-cell, as the ion-exchange membrane is not permeable to water. One half-cell contains the cathode, while the other half-cell contains the anode.

Disclosed herein is a flow-through electrolysis cell. The flow-through electrolysis cell is configured to catalyze the electrochemical reduction of a reactant, such as $CO_2$, which is dissolved in an electrolyte. Catalysis occurs when the electrolyte carries $CO_2$ into contact with the cathode of the flow-through electrolysis cell. The cathode may be constructed with a hierarchical nanoporous metal, such as hierarchical nanoporous copper (hnp-Cu). The hierarchical nanoporous copper cathode is permeable to the electrolyte allowing the solution to flow-through the cathode, which allows for increased mass-transport, increased surface area for catalysis to occur, and improved Faradaic efficiency, and selectivity. The flow-through concept takes advantage of the volumetric porosity of the electrode. The continuous flow of electrolyte through the cathode facilitates improved contact of the $CO_2$ with the catalyst when compared to traditional "flow-by" designs. Flow-by and flow-through setups are contrasted in FIG. 3 vs FIG. 4A or 4B.

The electrochemical reduction of $CO_2$ produces a variety of industrially useful compounds such as ethylene. Ethylene is a sought after feedstock in the chemical industry for the production of plastics, surfactants, detergents, polymers and other industrially important products. Nano-cube Cu surfaces provide much higher selectivity towards ethylene than smooth Cu surfaces do. Thus, the use of hierarchical nanoporous Cu to catalyze the reduction of $CO_2$ in the disclosed flow-through cell allows for targeted production of ethylene while realizing high current densities. The flow-through electrolysis cell with an hnp-Cu catalyst allows for accessing a higher catalyst surface area than in a flow-by, or non-nanoporous system. Thus, low reaction rates at lower overpotential can be tolerated, while still achieving high conversion rates.

Referring to FIG. 2A, a flow-through electrolysis cell includes a hierarchical nanoporous metal cathode (17); a metallic mesh anode (18); and an anion-exchange membrane (9). The hierarchical nanoporous metal cathode (17) is inside of a frame (4). A gasket (3) lies between the frame (4) and an endcap (2). An electrolyte-in line (1) passes through the endcap (2) by way of a first aperture (39) in the endcap (2). A $CO_2$ gas source (51) may be connected to the electrolyte-in line (1). Alternatively, $CO_2$ gas source (51) is not present and electrolyte used already contains $CO_2$. A gasket (5) is between the frame (4) and a reservoir (6). There is a reference electrode (16) passing into the flow-through electrolysis cell through the top of the reservoir (6) through a second aperture (37). The reference electrode (16), hierarchical nanoporous metal cathode (17), and metallic mesh anode (18) are connected to a potentiostat (47) and a power source (48). An electrolyte-out line (8) runs through the bottom of the reservoir (6) through a third aperture (40). A gasket (7) is between the reservoir (6) and the anion exchange membrane (AEM) (9).

The metallic mesh anode (18) may be positioned inside of a frame (11). Between the frame (11) and the AEM (9) is positioned a gasket (10). On the side of the frame (11) opposite gasket (10) is a gasket (12). The gasket (12) is positioned between the frame (11) and an endcap (13). Electrolyte-in line (14) passes through the endcap (13) through a fourth aperture (41) and an electrolyte-out line (15) passes through the endcap (13) through a fifth aperture (42).

A potentiostat (47) is connected to the cell to provide a potential to the electrodes. In some embodiments, the voltage provided by the potentiostat (47) is about 0.1V to about 10V. The power source (48) operates in constant current mode or constant voltage mode or the power source (48) is a pulsed power source.

Referring to FIG. 2B, a flow-through electrolysis cell includes a hierarchical nanoporous metal cathode (36); a metallic mesh anode (34); and a proton-exchange membrane (27). The hierarchical nanoporous metal cathode (36) is inside of a frame (22). A gasket (21) lies between the frame (22) and an endcap (20). An electrolyte-out line (19) passes through the endcap (20) by way of a first aperture (43) in the endcap (20). A gasket (23) is between the frame (22) and a reservoir (24). A reference electrode (25) is configured to pass into the flow-through electrolysis cell through the top of the reservoir (24) through a second aperture (38). The reference electrode (25), hierarchical nanoporous metal cathode (36), and metallic mesh anode (34) are connected to a potentiostat (50) and a power source (49). An electrolyte-in line (35) is configured to pass through the bottom of the reservoir (24) through a third aperture (44). A $CO_2$ gas source (52) may be connected to the electrolyte-in line (35). $CO_2$ gas source (52) may be absent where the electrolyte used already has $CO_2$. A gasket (26) may be positioned between the reservoir (24) and the proton-exchange membrane (PEM) (27).

The metallic mesh anode (34) may be positioned within a frame (29). Between the frame (29) and the PEM (27) is positioned a gasket (28). On the side of the frame (29) opposite gasket (28) may be positioned a gasket (30). The gasket (30) is positioned between frame (29) and an endcap (31). An electrolyte-in line (32) passes through the endcap (31) through a fourth aperture (45) and an electrolyte-out line (33) passes through the endcap (31) through a fifth aperture (46).

The voltage provided by the potentiostat (50) is from about 0.1V to about 10V. The power source (49) operates in constant current mode or constant voltage mode or the power source (49) is a pulsed power source.

The frames, reservoirs, and/or endcaps may be individually constructed of any suitable material. Suitable materials include, but are not limited to polymers, glasses, ceramics, metals, and composite materials. In some embodiments, the frames, reservoirs, and/or endcaps may be constructed of a polymer such as, but not limited to, polyolefins, polyacrylates, and/or polycarbonates. The gaskets may be constructed of a sealing material such as natural or synthetic rubbers.

In one aspect, a flow-through electrolysis cell is provided. The cell includes a cathode including a hierarchical nanoporous metal; an anode including a metallic mesh; and an ion-exchange membrane; wherein the hierarchical nanoporous metal is a catalytic metal for reduction of a reactant which contacts the hierarchical nanoporous metal.

In some embodiments, the hierarchical nanoporous metal includes one or more of copper, platinum, silver, gold, nickel, iron, and zinc. In some embodiments, the hierarchical nanoporous metal may be copper. In some embodiments, the hierarchical nanoporous metal is a dealloyed metal alloy. Where the hierarchical nanoporous metal is hierarchical nanoporous copper, the hierarchical nanoporous copper may be a dealloyed aluminum-copper alloy. The hierarchical nanoporous metal may have an average nanopore diameter of about 10 nm to about 500 nm and an average macropore diameter of about 500 nm to about $10^6$ nm. In some embodiments, the hierarchical nanoporous metal may have an average nanopore diameter of about 10 nm to about 200 nm and an average macropore diameter of about 500 nm to about $10^6$ nm.

The metallic mesh may include one or more of platinum, porous platinum, iridium, nickel, iron, palladium, carbon, and boron-doped carbon/diamond. In some embodiments, the metallic mesh includes platinum. The metallic mesh may include a plurality of pores having an average pore diameter of about 1 μm to about 10,000 μm.

The flow-through electrolysis cell may also include a reference electrode. In some embodiments, the reference electrode may include one or more of silver, copper, platinum, palladium, mercury, and hydrogen. In some embodiments, the reference electrode includes silver.

In any of the above embodiments, the reactant is $CO_2$.

The cathode may have a first face and an opposite facing second face, the flow-through electrolysis cell further including a first electrolytic fluid input proximal to the first face and a first electrolytic fluid output proximal to the second face, such that the cell is configured to convey an electrolyte through the hierarchical nanoporous metal.

As noted above, the electrolyte may include dissolved $CO_2$ as a reactant. The electrolyte may include a salt such as $KHCO_3$, or a buffer such as $KH_2PO_4/K_2HPO_4$. In some embodiments, the salt and/or buffer may be present from 0.1 M to 5 M, preferably between 0.1 M and 1 M.

The ion-exchange membrane may be an anion exchange membrane (AEM), or a proton exchange membrane (PEM) depending upon the configuration of the cell.

In another aspect, a method of reducing $CO_2$ is provided using the flow-through electrolysis cell described herein. The method includes contacting the $CO_2$ with a cathode housed in a flow-through electrolysis cell, where the cathode includes a hierarchical nanoporous metal. The flow-through electrolysis cell includes an anode and an ion-exchange membrane, where the anode includes a metallic mesh. In such methods, the $CO_2$ is dissolved in an electrolyte, and the contacting $CO_2$ with the cathode includes flowing the electrolyte through the cathode.

In some embodiments, the $CO_2$ is dissolved in the electrolyte by bubbling $CO_2$ gas into the electrolyte to saturate the electrolyte with $CO_2$. In some embodiments, the $CO_2$ is present in the electrolyte at a concentration of about 0.05 $cm^3$/ml electrolyte to about 5.0 $cm^3$/ml electrolyte. In some embodiments, the electrolyte includes co-solvent(s), for example, methanol and/or ethanol.

The method may also include collecting a reduction product from the apparatus. The reduction product may include materials such as, but not limited to, a hydrocarbon, an aldehyde, an alcohol, a ketone, a carboxylic acid, or a mixture of any two or more thereof. The method includes collecting a reduction product that may be ethylene, methane, or a mixture thereof.

In some of the above embodiments, the method may also include monitoring the composition of product(s) using an analytical technique. In another embodiment, the analytical technique is gas chromatography mass spectrometry (GCMS).

In some embodiments the hierarchical nanoporous metal is prepared by dealloying a metal alloy. In another embodiment the hierarchical nanoporous metal is prepared by direct ink writing.

The stability of the hierarchical nanoporous metal against electrochemical potential and reaction conditions may be increased by adding one or more step-edge pinning agent(s) to the hierarchical nanoporous metal. In some embodiments, the step-edge pinning agent(s) are included in a concentration greater than 0 but less than 5% by weight. In some embodiments, the step-edge pinning agent(s) may be added via atomic layer deposition. Step-edge pinning agents may be alumina or titania.

Alternative to, or in addition to the step-edge agent(s), the stability of the hierarchical nanoporous metal against electrochemical potentials and reaction conditions may be increased by doping the metal alloy used to produce the hierarchical nanoporous metal with one or more metals (for example, nickel) having a melting point greater than about 1,500° C.

In any of the above embodiments, flowing includes applying a pressure gradient across the cathode, in a further embodiment the pressure gradient is from about 0.1 atm to about 10 atm. In any of the above embodiments, the electrolyte flows through the cathode at a velocity of less than about 1 cm/s.

In any of the above embodiments, the electrolyte may contain a salt, such as, but not limited to, $KH_2PO_4$, $K_2HPO_4$, or $KHCO_3$. In any of the above embodiments the $KH_2PO_4$, $K_2HPO_4$, or $KHCO_3$ may be present in the electrolyte from about 0.1 M to about 5 M. In some embodiments, the electrolyte is saturated with $CO_2$.

In any of the above embodiments the cathode includes one or more of copper, platinum, silver, gold, nickel, iron and zinc. In any of the above embodiments, the anode includes one or more of platinum, palladium, carbon and boron-doped carbon/diamond.

The following examples are intended to illustrate the invention and should not be construed as limiting the invention in any way.

EXAMPLES

Example 1: Preparation of hnp-Cu

The hierarchical nanoporous copper may be prepared by dealloying an aluminum-copper alloy. An Al—Cu alloy, $Al_{75}Cu_{25}$, is melted in a horizontal tube furnace at 800° C. under argon for 24 hr at a ramp rate of 5° C./min. This melted alloy is then cooled down and solidified at 2° C./min until reaching room temperature. Dealloying is then accomplished by chemically dealloying the alloy in 1M HCl at 5° C. under vacuum. The $Al_{75}Cu_{25}$ alloy, after melting and cooling, contains both pre-eutectic $Al_2Cu$ and lamellar eutectic $\alpha$-Al/$Al_2Cu$. If desired, the size of the hnp-Cu channels formed after dealloying are increased by varying the solidification time of molten alloy. This increases the thickness of the Al lamella that define the size of the macroporous flow channels formed during dealloying.

Example 2: Electrolyte Preparation

The electrolyte is based upon a $KH_2PO_4$/$K_2HPO_4$ buffer. The $KH_2PO_4$ and $K_2HPO_4$ are present at a concentration between 0.1 M to 5 M. The pH value of the solution may be verified on a pH meter calibrated with two standard buffer solutions. The pH range can be between 5 and 12, preferably between 7 and 10. An alternative electrolyte is prepared as a 0.1 M to 5 M $KHCO_3$ solution. $CO_2$ is bubbled through the electrolyte during operation of the flow-through cell to saturate the electrolyte with $CO_2$.

Example 3: Reduction of $CO_2$ Using Flow-Through Electrolysis Cell with AEM $CO_2$ is reduced using the flow-through electrolysis cell of FIG. 2A by filling the cell with electrolyte by forcing electrolyte into the cell under pressure through the electrolyte-in lines (1) and (14). The cell is connected to the power source (48) which may operate in constant current mode, constant voltage mode or pulsed mode. A potentiostat (47) is connected to the flow-through electrolysis cell and operates at a potential of about 0.1V to about 10V. A $CO_2$ gas source (51) bubbles $CO_2$ into the electrolyte-in line (1) before it enters the cell so as to saturate the electrolyte with $CO_2$. Alternatively, $CO_2$ gas source (51) is not present and electrolyte used already contains $CO_2$. Electrolyte already containing $CO_2$ is prepared by bubbling $CO_2$ through electrolyte described in Example 2. As the pressure forces electrolyte to flow-through the hierarchical nanoporous metal cathode (17), reduction of $CO_2$ is catalyzed. Electrolyte subsequently flows into reservoir (6) and out of the cell through electrolyte-out line (8).

While the reduction of $CO_2$ occurs at the cathode, oxidation of water occurs at the metallic mesh anode (18) when the electrolyte is forced into the cell under pressure through electrolyte-in line (14) and bathes the anode. Electrolyte subsequently leaves the cell through electrolyte-out line (15). A steady flow of electrolyte is maintained in this fashion. Electrolyte flowing-through the hierarchical nanoporous metal cathode (17) and electrolyte at the metallic mesh anode (18) are kept from intermixing by the AEM (9).

Example 4: Reduction of $CO_2$ Using Flow-Through Electrolysis Cell with PEM $CO_2$ is reduced using the flow-through electrolysis cell of FIG. 2B by filling the cell with electrolyte by forcing electrolyte into the cell under pressure through the electrolyte-in lines (35) and (32). The cell is connected to the power source (49) that may operate in constant current mode, constant voltage mode or pulsed mode. A potentiostat (50) is connected to the flow-through electrolysis cell and operates at a potential of about 0.1V to about 10V. The cell is connected to the power source (49) and the potentiostat (50). A $CO_2$ gas source (52) bubbles $CO_2$ into the electrolyte-in line (35) before it enters the cell so as to saturate the electrolyte with $CO_2$. Alternatively, $CO_2$ gas source (52) is not present and electrolyte used already contains $CO_2$. The pressure forces electrolyte to flow into the reservoir (24) then to flow-through the hierarchical nanoporous metal cathode (36) where reduction of $CO_2$ is catalyzed. Electrolyte subsequently flows out of the flow-through electrolysis cell through the electrolyte-out line (19).

While the reduction of $CO_2$ occurs at the cathode, oxidation of water occurs at the metallic mesh anode (34) when electrolyte is forced into the cell under pressure through electrolyte-in line (32) and bathes the anode. Electrolyte subsequently leaves the cell through electrolyte-out line (33). A steady flow of electrolyte is maintained in this fashion. Electrolyte flowing-through the hierarchical nanoporous metal cathode (36) and electrolyte at the metallic mesh anode (34) are kept from intermixing by the PEM (27).

Example 5: Hnp-Cu Morphological and Chemical Characterization

Morphological and chemical changes to the hnp-Cu electrode occurring during operation of the cell may be monitored using synchrotron-based in-situ scattering, preferably resonant soft x-ray scattering (RSoXS) and spectroscopy. To do so, the cathode is illuminated with x-rays and the scattering of x-rays incident upon the cathode is then monitored spectroscopically.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims. What is claimed is:

1. A method of reducing $CO_2$, the method comprising:

contacting $CO_2$ with a cathode housed in a flow-through electrolysis cell;

wherein the cathode comprises a hierarchical nanoporous metal;

wherein the flow-through electrolysis cell comprises an anode and an ion-exchange membrane, wherein the anode comprises a metallic mesh;

wherein the $CO_2$ is dissolved in an electrolyte;

wherein contacting $CO_2$ with the cathode comprises flowing the electrolyte through the cathode; and wherein the cathode comprises a first face and an opposite facing second face, the flow-through electrolysis cell further comprising a first electrolytic fluid input proximal to the first face and a first electrolytic fluid output proximal to the second face, wherein the electrolyte is flowed substantially perpendicular to the first face of the cathode that is substantially parallel to the ion-exchange membrane.

2. The method of claim 1 further comprising collecting a reduction product comprising a hydrocarbon, an aldehyde, an alcohol, a ketone, a carboxylic acid, or a mixture of any two or more thereof.

3. The method of claim 2, wherein the method further comprises monitoring the reduction product via gas chromatography mass spectrometry (GCMS).

4. The method of claim 1 further comprising collecting a reduction product comprising ethylene, methane, or a mixture thereof.

5. The method of claim 1, wherein flowing comprises applying a pressure gradient across the cathode.

6. The method of claim 5, wherein the pressure gradient is from about 0.1 atm to about 10 atm.

7. The method of claim 1, wherein the electrolyte flows through the cathode at a velocity of less than about 1 cm/s.

8. The method of claim 1, wherein the cathode is between an electrolyte-in line and an electrolyte-out line of the flow-through electrolysis cell.

9. The method of claim 1, wherein the hierarchical nanoporous metal comprises one or more of copper, platinum, silver, gold, nickel, iron, and zinc.

10. The method of claim 1, wherein the hierarchical nanoporous metal is hierarchical nanoporous copper.

11. The method of claim 10, wherein the hierarchical nanoporous copper is a dealloyed aluminum-copper alloy.

12. The method of claim 1, wherein the hierarchical nanoporous metal is a dealloyed metal alloy.

13. The method of claim 1, wherein the hierarchical nanoporous metal comprises nanopores with an average diameter of about 10 nm to about 500 nm and macropores with an average diameter of about 500 nm to about $10^6$ nm.

14. The method of claim 1, wherein the metallic mesh comprises one or more of platinum, palladium, carbon and boron-doped carbon/diamond.

15. The method of claim 1, wherein:

the cathode is between an electrolyte-in line and an electrolyte-out line; and the hierarchical nanoporous metal is a catalytic metal for reduction of a reactant which contacts the hierarchical nanoporous metal.

* * * * *